US007025208B2

(12) United States Patent
Baker et al.

(10) Patent No.: US 7,025,208 B2
(45) Date of Patent: Apr. 11, 2006

(54) BULK BAG WITH INTEGRAL PALLETS

(75) Inventors: Gerald Lynn Baker, Ardrossan (CA); Richard Stephen Michaels, St. Albert (CA)

(73) Assignee: LSI-Lift Systems Incorporated, Edmonton (CA)

( * ) Notice: Subject to any disclaimer, the term of this patent is extended or adjusted under 35 U.S.C. 154(b) by 0 days.

(21) Appl. No.: 10/622,844

(22) Filed: Jul. 18, 2003

(65) Prior Publication Data

US 2004/0025756 A1 Feb. 12, 2004

(30) Foreign Application Priority Data

Jul. 18, 2002 (CA) ..... 2,394,195

(51) Int. Cl.
*B65D 19/00* (2006.01)

(52) U.S. Cl. ..... 206/599; 206/600; 206/386

(58) Field of Classification Search ..... 206/386, 206/595–600; 108/55.1, 55.5
See application file for complete search history.

(56) References Cited

U.S. PATENT DOCUMENTS

| | | | | |
|---|---|---|---|---|
| 2,159,622 | A * | 5/1939 | Sanford | 410/52 |
| 3,165,078 | A | 1/1965 | White | 108/56 |
| 3,329,103 | A | 7/1967 | Cohen | 108/54 |
| 3,469,542 | A | 9/1969 | Ahlenius | 108/56 |
| 3,651,769 | A | 3/1972 | Foley | 108/56 |
| 3,878,796 | A | 4/1975 | Morrison | 108/56 |
| 3,880,286 | A * | 4/1975 | Wegener | 206/597 |
| 3,946,833 | A * | 3/1976 | Riehlmann | 182/20 |
| 4,319,529 | A * | 3/1982 | Beal | 108/51.3 |
| 4,830,191 | A * | 5/1989 | Dijksman | 206/599 |
| 5,044,502 | A * | 9/1991 | Hale | 206/595 |
| 5,170,722 | A | 12/1992 | Friesner et al. | 108/56 |
| 5,440,998 | A * | 8/1995 | Morgan et al. | 108/57.18 |
| 5,456,189 | A | 10/1995 | Belle Isle | 108/51.1 |
| 5,461,988 | A | 10/1995 | Cummings et al. | 108/51.3 |
| 5,507,237 | A * | 4/1996 | Barrow et al. | 108/55.1 |
| 5,676,063 | A | 10/1997 | Wallace | 108/51.1 |
| 5,794,543 | A | 8/1998 | John et al. | 108/56.1 |
| 5,809,905 | A | 9/1998 | John et al. | 108/56.1 |
| 6,213,305 | B1 * | 4/2001 | Baker et al. | 206/599 |
| 6,263,807 | B1 | 7/2001 | Fox et al. | 108/57.25 |
| 6,299,011 | B1 * | 10/2001 | Rosenfeldt | 220/4.29 |
| 6,332,098 | B1 * | 12/2001 | Ross et al. | 700/226 |
| 6,467,625 | B1 | 10/2002 | Baker et al. | 206/599 |
| D492,835 | S * | 7/2004 | Michaels et al. | D34/38 |
| 2003/0005862 | A1 | 1/2003 | Halavais | 108/56.1 |
| 2003/0107515 | A1 * | 6/2003 | Howard | 342/357.07 |

FOREIGN PATENT DOCUMENTS

| | | | |
|---|---|---|---|
| CA | 2205840 | | 11/1995 |
| CA | 2310556 | | 7/2000 |
| EP | 0115551 | A1 * | 8/1984 |
| GB | 2161452 | | 1/1986 |
| GB | 2161452 | A * | 1/1986 |

* cited by examiner

*Primary Examiner*—Mickey Yu
*Assistant Examiner*—Jerrold Johnson
(74) *Attorney, Agent, or Firm*—Davis & Bujold, P.L.L.C.

(57) ABSTRACT

A bulk bag with integral pallets includes a flexible bag body having a bottom and sidewalls. Two elongate pallet members are provided having axially extending openings adapted to receive fork tines from a fork lift. Each of the two elongate pallet members has at least one underlying wear pad. The two elongate pallet members are secured to the bottom of the bag body with the least one underlying wear pad exposed. The securing straps, laces or elasticized sleeves are protected from wear by the underlying wear pad which provides an underlying wear surface.

15 Claims, 11 Drawing Sheets

BULK BAG WITH INTEGRAL PALLETS

FIELD OF THE INVENTION

The present invention relates to a bulk bag used to transport commodities in bulk and, more particularly, a bulk bag that has integral pallets.

BACKGROUND OF THE INVENTION

Bulk bags are large bags used to transport commodities in bulk form. They are currently transported on wooden pallets. Wooden pallets increase the weight and cost of shipping bulk product.

Published United Kingdom Patent Application 2,161,452 (Hourston et al 1986) discloses a bulk bag with integral wooden pallets. The Hourston et al reference teaches the use of two small wooden pallets in the form of elongate box sections which serve as guides to receive the tines of a fork lift mechanism. These elongate box section wooden pallets are received in loop-form sleeves secured to a bottom of the bulk bag. The Hourston et al reference advanced the art by reducing the size and, hence, the weight of the elongate box section wooden pallets. However, a problem with the elongate box section pallets, as taught by Hourston et al, is that they frequently slide out of the sleeves in which they are positioned. Attempts to glue the elongate box section pallets within the sleeves have been unsuccessful.

U.S. Pat. No. 6,213,305 (Baker et al 2001) discloses a bulk bag with integral pallets that overcomes the problem of accidental displacement of the elongate box section pallets from their sleeves. The Baker et al reference teaches the placement of elastic sleeves at opposed ends of the sleeves. The elastic sleeves elastically deform the opposed ends, thereby, precluding the elongate box section pallets from being inadvertently withdrawn from the sleeves. However, a problem incurred with the bulk bags, as taught by Baker et al, is rapid wear on the sleeves.

U.S. Pat. No. 6,467,625 (Baker et al 2002) discloses a bulk bag with integral pallets in which rigid fork lift tine receiving members are inserted into slleves depending from the bottom of the bulk bag. The sleeve is made from a material with sufficient elasticity to stretch to receive the rigidifying insert and then contract to inhibit the rigidifying insert from being withdrawn from the sleeve.

SUMMARY OF THE INVENTION

What is required is a bulk bag with integral pallets which will be more durable.

According to the present invention there is provided a bulk bag with integral pallets which includes a flexible bag body having a bottom and sidewalls. At least two elongate pallet members are provided having axially extending openings adapted to receive fork tines from a fork lift. Each of the at least two elongate pallet members has at least one underlying wear pad. Means is provided for securing each of the at least two elongate pallet members to the bottom of the bag body with the least one underlying wear pad exposed. The securing means are protected from wear by the at least one underlying wear pad which provides an underlying wear surface.

With the bulk bag with integral pallets, as described above, in order to avoid the wear to the sleeve, the elongate pallet members are made with underlying wear pads. It is envisaged that two or three of the wear pads will be provided. In order to leave the wear pads exposed, the elongate pallet members are secured to the bottom of the bag body with straps, laces or elasticized sleeves. These straps, laces or elasticized sleeves are protected from wear by the wear pads.

It is preferred that the elongate pallet members be made from polymer plastic. The wear pads can be made removable from the elongate pallet members for replacement as wear occurs or the wear pads can be integrally moulded as part of each of the polymer plastic pallet members.

It is envisaged that the polymer plastic pallets members will be formed in a generally tubular configuration with weight reducing voids. This can be done in one of two ways. If an extrusion moulding process is used, a tubular body will be formed. The body then will be machined to provide the weight reducing voids in the form of perforations and cut outs. If an injection moulding process is, used, the "perforations" and "cut outs" will be provided in the mould. The terms "perforations" and "cut outs", are intended to cover such weight reducing voids, even if such voids are incorporated into an injection moulding process.

It is preferred that the axially extending openings are fluted, as this provides a guide for the entry of fork tines from the fork lift.

It is undesirable that there be relative axial movement the elongate pallet members and the bulk bag. It is, therefore, preferred that each of the elongate pallet members have a textured top gripping surface adapted to frictionally engage the bottom of the bulk bag. Beneficial results have been obtained through the use of ribs. It is preferred that the ribs be generally parallel and extend transversely across the elongate pallet members.

The sagging of the bulk bag makes it difficult to put into position pallet jacks and some other forms of mechanized pallet handling equipment. When the needs of the application require it for use with a particular type of mechanized pallet handling equipment, it is preferred that each of the elongate pallet members has either a single wing or a series of wings extending laterally from one side.

Most sophisticated materials handling companies prefer to electronically monitor their shipments. It is, therefore, preferred that one of the two elongate pallet members has an electronic identification carrier adapted to be identify said elongate pallet member and distinguish it from other pallet members upon electronic interrogation. This can be as simple as a bar code identifier or as elaborate as a microchip used to store other relevant material relating to the shipment.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
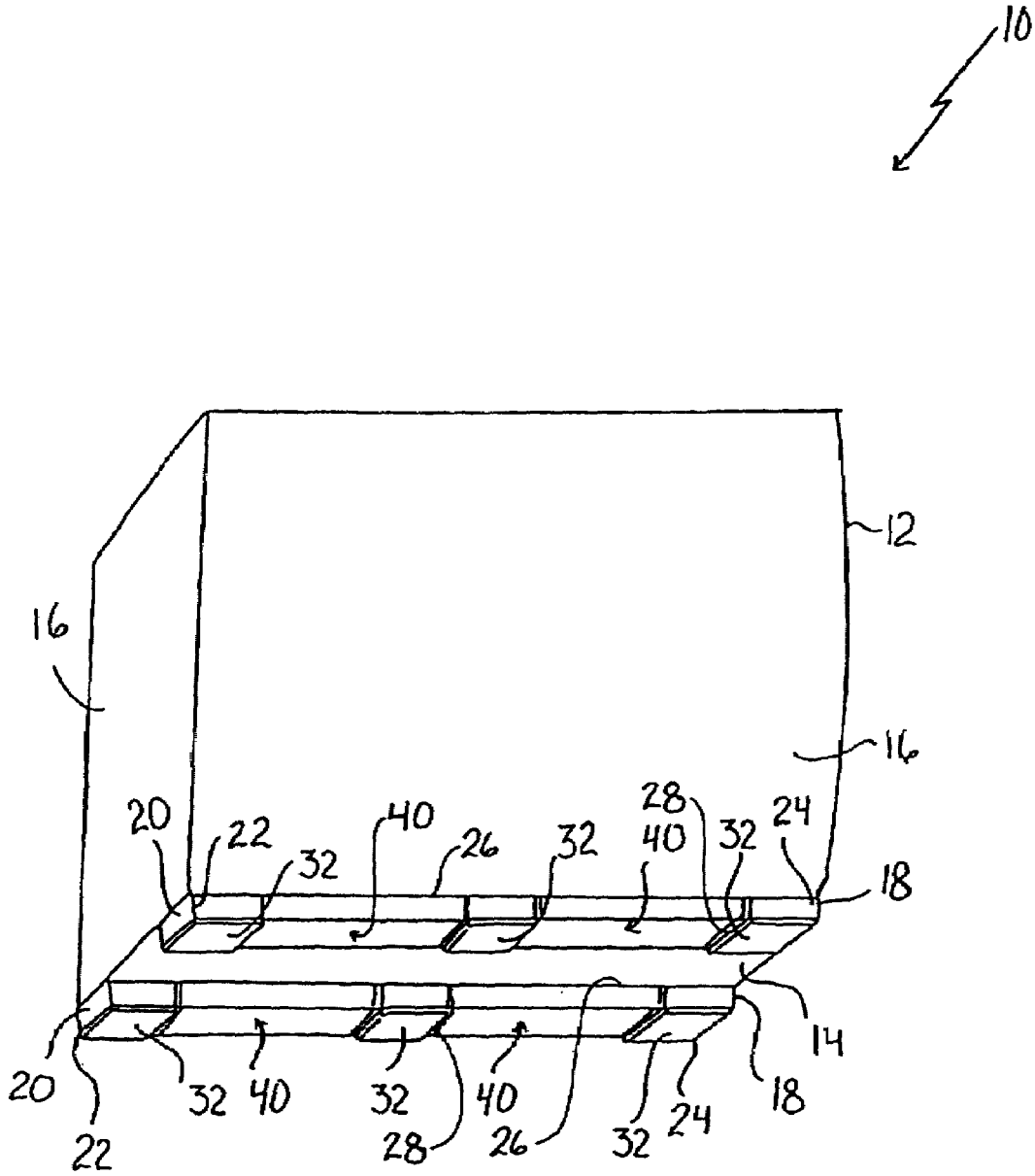
FIG. 1 is a detailed bottom perspective view of a preferred embodiment bulk bag with integral pallets constructed in accordance with the teachings of the present invention.

The preferred embodiment, a bulk bag with integral pallets generally identified by reference numeral 10, will now be described with reference to FIGS. 1 and 2. Alternative embodiments will be thereafter be described with reference to FIGS. 3 through 12.

Structure and Relationship of Parts:

Referring to FIG. 1, bulk bag 10 includes a flexible bag body 12 which has a bottom 14 and sidewalls 16. Two polymer plastic elongate pallet members 18 are provided which have axially extending openings 20 adapted to receive fork tines from a fork lift. Each of elongate pallet members 18 has a first end 22, a second end 24, a top surface 26 and a bottom surface 28. Referring to FIG. 2, in the illustrated embodiment, openings 20 at first end 22 and second end 24 of each elongate pallet member 18 are fluted. A hook hold aperture 30 is provided in top surface 26 at first end 22 of each of pallet members 18 although it will be appreciated that hook hold apertures 30 could be also be provided at second end 24 of each elongate pallet member 18.

Figure 2:
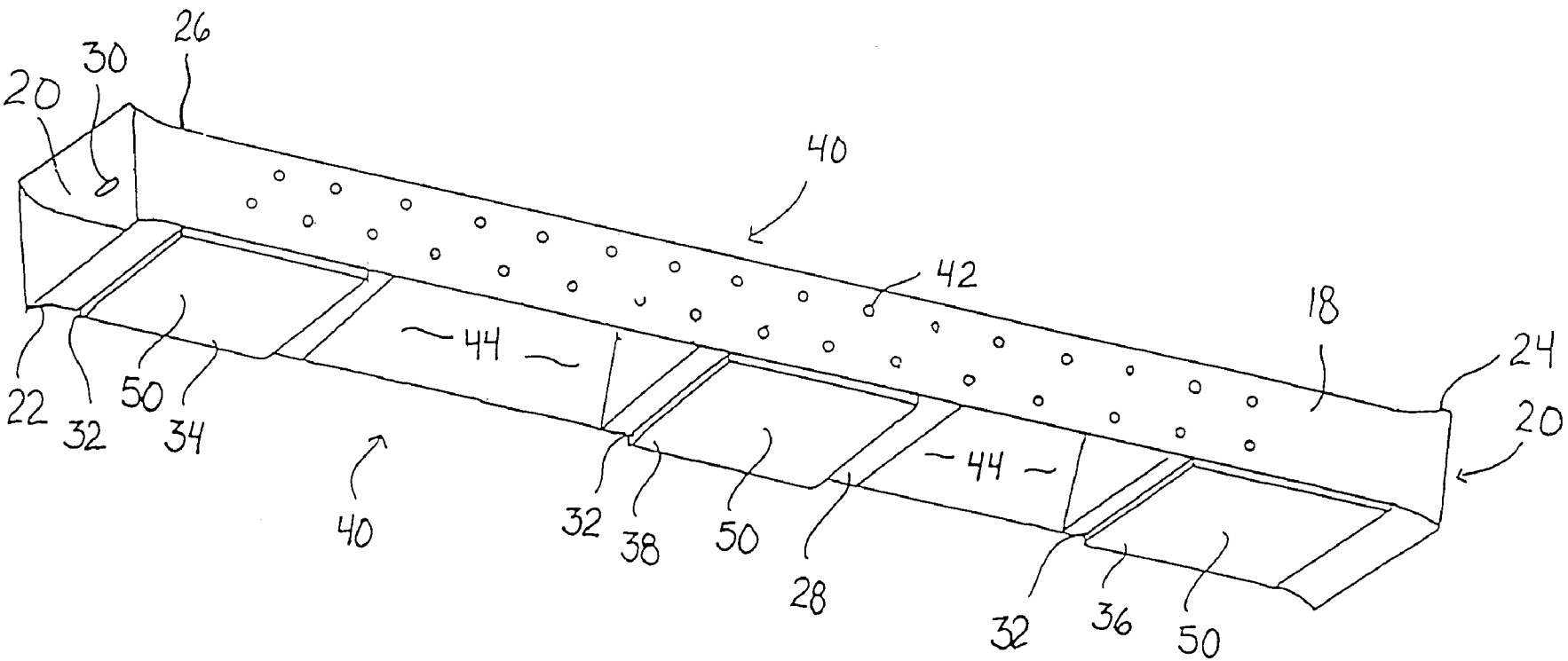
FIG. 2 is a perspective bottom view of one of the elongate pallet members for the bulk bag illustrated in FIG. 1.
Figure 3:
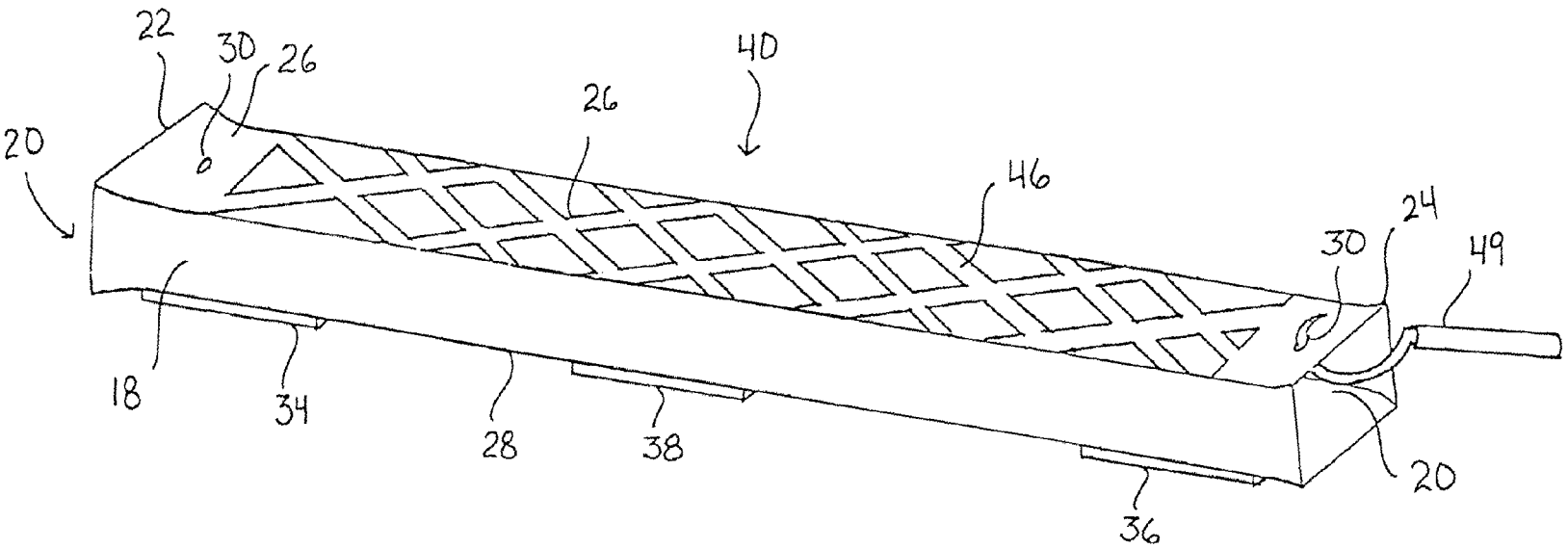
FIG. 3 is a detailed top perspective view of another of the elongate pallet members for the bulk bag illustrated in FIG. 1.

Referring to FIG. 2, three underlying wear pads 32 are provided along bottom surface 28 including a first wear pad 34 adjacent first end 22, a second wear pad 36 adjacent second end 24 and a third wear pad 38 positioned intermediate first wear pad 34 and second wear pad 36. While the illustrated embodiment shows three wear pads 32, it will be appreciated that there could be any number of wear pads 32. Wear pads 32 are integrally moulded as part of each polymer plastic pallet members 18. Elongate pallets members 18 are fabricated in a generally tubular configuration with weight reducing voids generally referenced by numeral 40 which include perforations 42 and cut outs 44. Referring to FIG. 3, weight reducing voids 40 can also include lattice style strips 46. It will be appreciated that a variety of other shapes of weight reducing voids 40 which can be used to reduce the weight of each pallet member 18.

Referring to FIG. 1, elongate pallet members 18 are secured to bottom 14 of bag body 12 by elasticized sleeves 48 with underlying wear pads 32 left exposed with provide an underlying wear surface 50. Elasticized sleeves 48 span the distance in between each of underlying wear pads 32. The positioning of elasticized sleeves 48 prevents any axial movement of pallet members 18 during movement of bag body 12.

Operation:

The use an operation of bulk bag with integral pallets generally identified by reference numeral 10, will now be described with reference to FIGS. 1 and 2. Referring to FIG. 1, in order to use bulk bag pallets 10, as described above, pallet members 18 are secured by elasticized sleeves 48 to bottom 14 of bag body 12. Once pallet members 18 are properly secured to bottom 14 of bag body 12, pallet members 18 are ready to receive fork tines from a fork lift. Referring to FIG. 2, openings 20 at first end 22 and second end 24 of each pallet member 18 are fluted so that fork tines are guided into axially extending openings 20 of each pallet member 18. Underlying wear pads 32 serve as wear surfaces 50 and protect elasticized sleeves 48 from wear. Referring to FIG. 1, in the event, elongate pallet members 18 are to be removed from elasticized sleeves 48, or other securing means, a hooked tool 49 illustrated in FIG. 3 can be inserted through hook hold aperture 30 to assist in pulling each pallet member 18 from elasticized sleeves 48.

Figure 4:
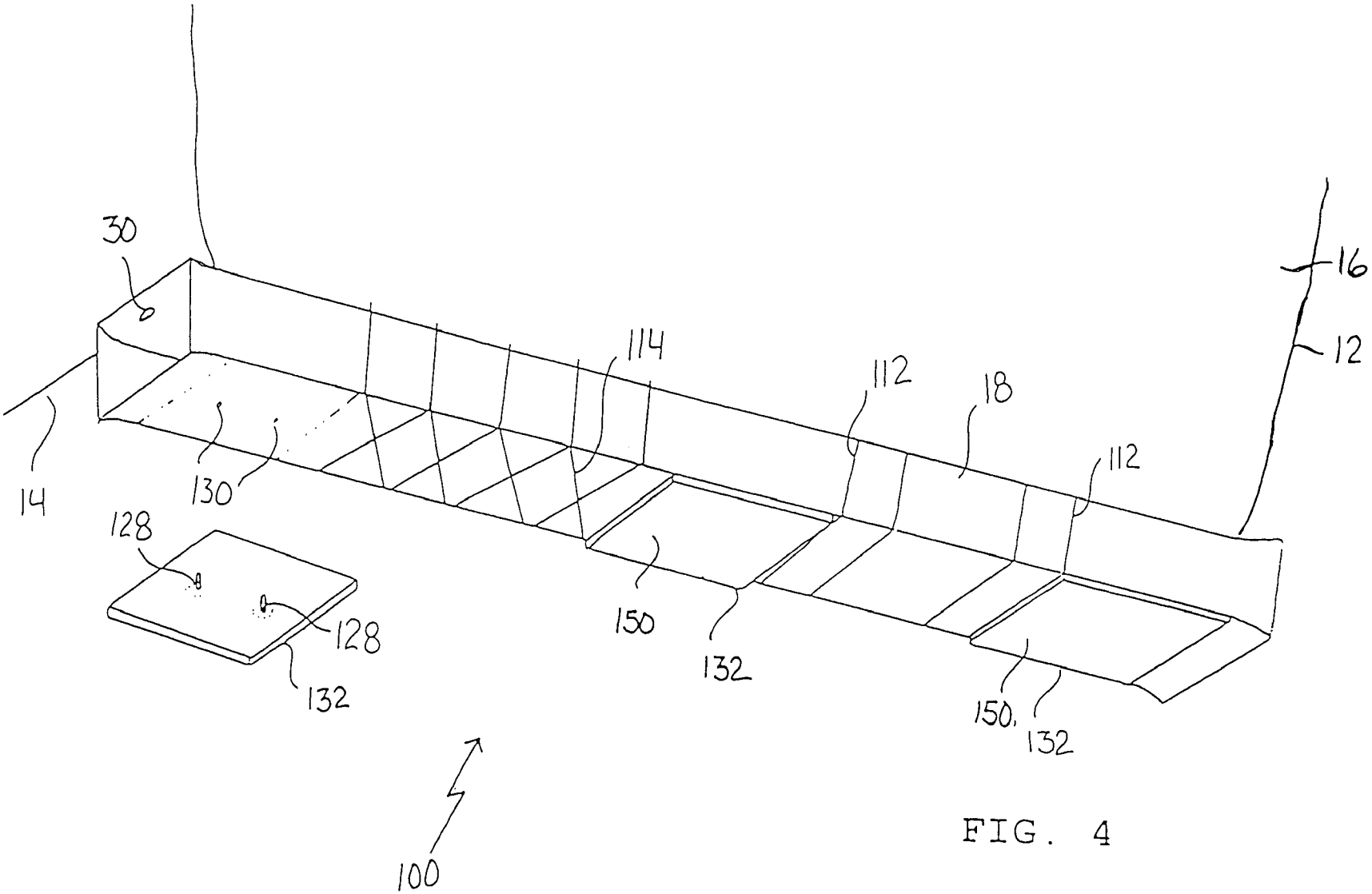
FIG. 4 is a partially exploded detailed bottom perspective view of a second embodiment of bulk bag constructed in accordance with the teachings of the present invention.

Variations:

Referring to FIG. 4, there is provided a second embodiment bulk bag generally identified by reference numeral 100. Alternative embodiment 100 has been selected to demonstrate variations. For example, there is illustrated that pallet members 18 may also be attached to bottom 14 of bulk bag 100 using straps 112 or laces 114. With laces 114 and straps 112, underlying wear pads 132 are still left exposed with straps 112 or laces 114 positioned between and being protected from wear by underlying wear pads 132 which provide an underlying wear surface 150. With alternative embodiment 100, wear pads 132 are detachable so as to facilitate replacement as wear occurs. In the illustrated embodiment, detachable wear pads 132 have embedded fasteners 128 and pallet members 18 have apertures 130 which are adapted to receive embedded fasteners 128 so as to secure detachable wear pad 132 to pallet member 18.

Figure 5:
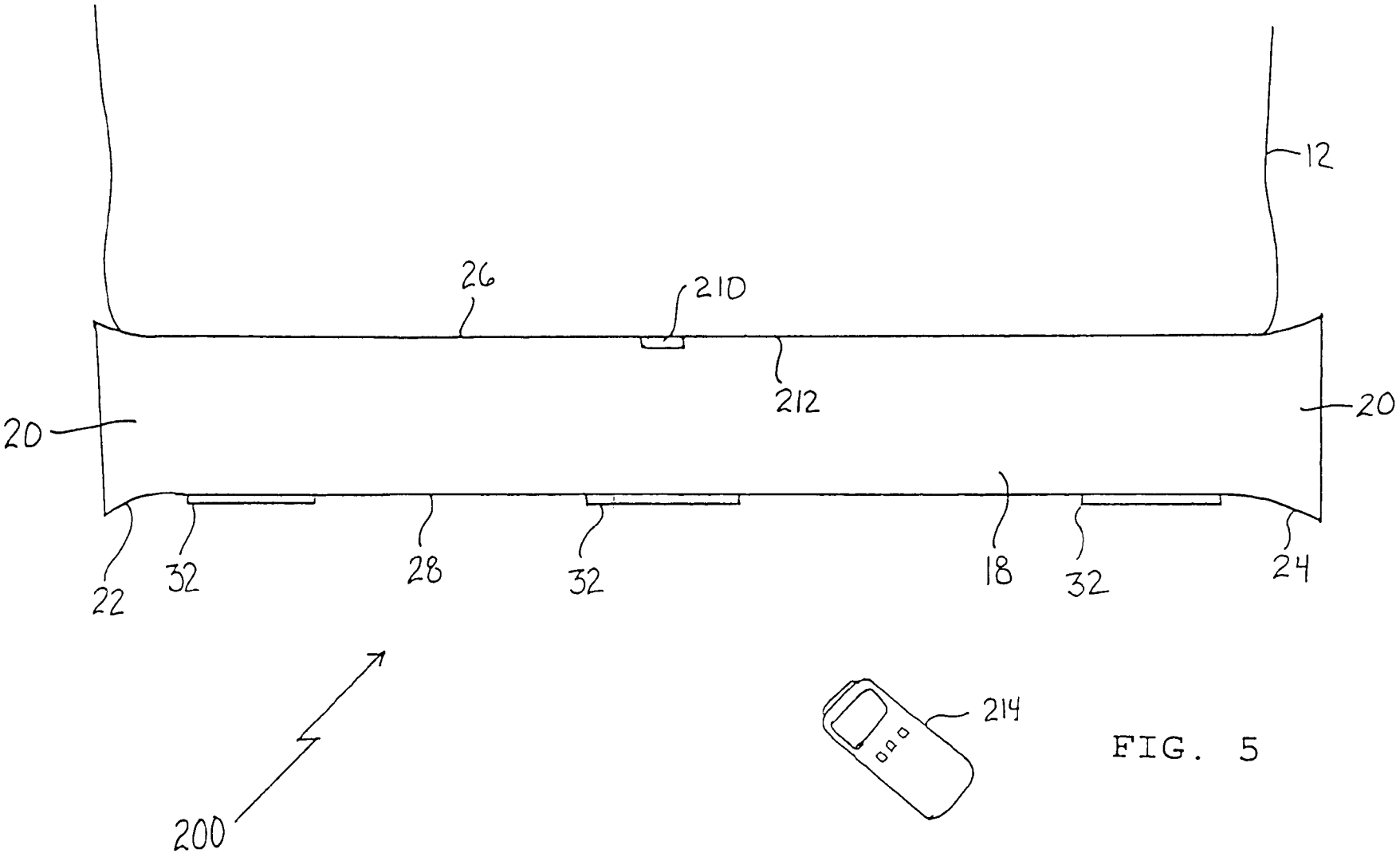
FIG. 5 is side elevation view, in section, of a third embodiment of bulk bag which includes a microchip.

Referring to FIG. 5, there is illustrated a third embodiment of bulk bag generally referenced by numeral 200 which includes a microchip 210. Microchip 210 is secured to an interior surface 212 of pallet member 18 intermediate first end 22 and second end 24 of pallet member 18. Microchip 210 can retain information regarding the material contained in bag body 12, such as nature of the contents, weight, volume, quantity, storage location, expiry date or even shipping destination. Information can be downloaded from microchip 210 by a hand scanner 214 or other suitable device for reading information from microchip 210. With this information one can track the location of pallet member 18 within a storage warehouse or transportation network. In addition, microchip 210 can carry the electronics necessary to function as part of a global positioning system, which will enable it's location to always be determinable through global positioning.

Figure 6:
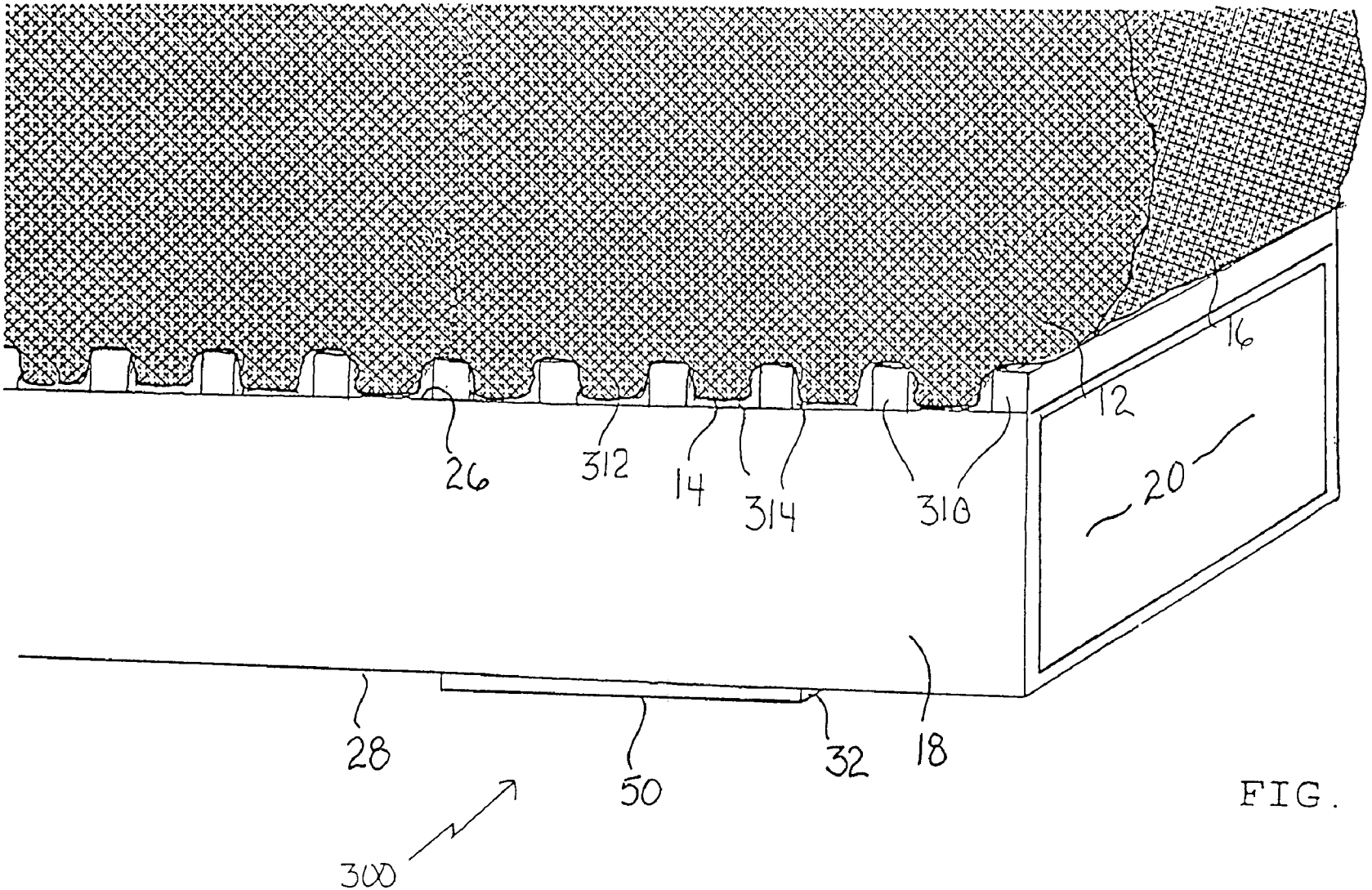
FIG. 6 is an perspective view, in section, of a forth embodiment of bulk bag which has retaining ribs.

Referring to FIG. 6, there is illustrated a forth embodiment of bulk bag generally reference by numeral 300 which includes retaining ribs 310 that extend laterally across upper surface 26 of each pallet member 18. As bag body 12 of bulk bag 300 is filled with material 312, bottom 14 of bag body 12 fills channels 314 which are formed between retaining ribs 310. The weight of material 312 at bottom 14 of bag body 12 sinks bottom 14 of bag body 12 into channels 314. Ribs 310 tend provide traction to prevent bag body 12 from sliding on top surface 26 of pallet members 18. While the illustrated embodiment shows retaining ribs 310 as extending laterally, retaining ribs 310 could also extend longitudinally along upper surface 26 of each pallet member 18. Other forms of traction or gripping surfaces could be applied to top surface 26 of pallet member 18 to minimize sliding movement of bag body 12 on top surface 26 of pallet member 18.

Figure 7:
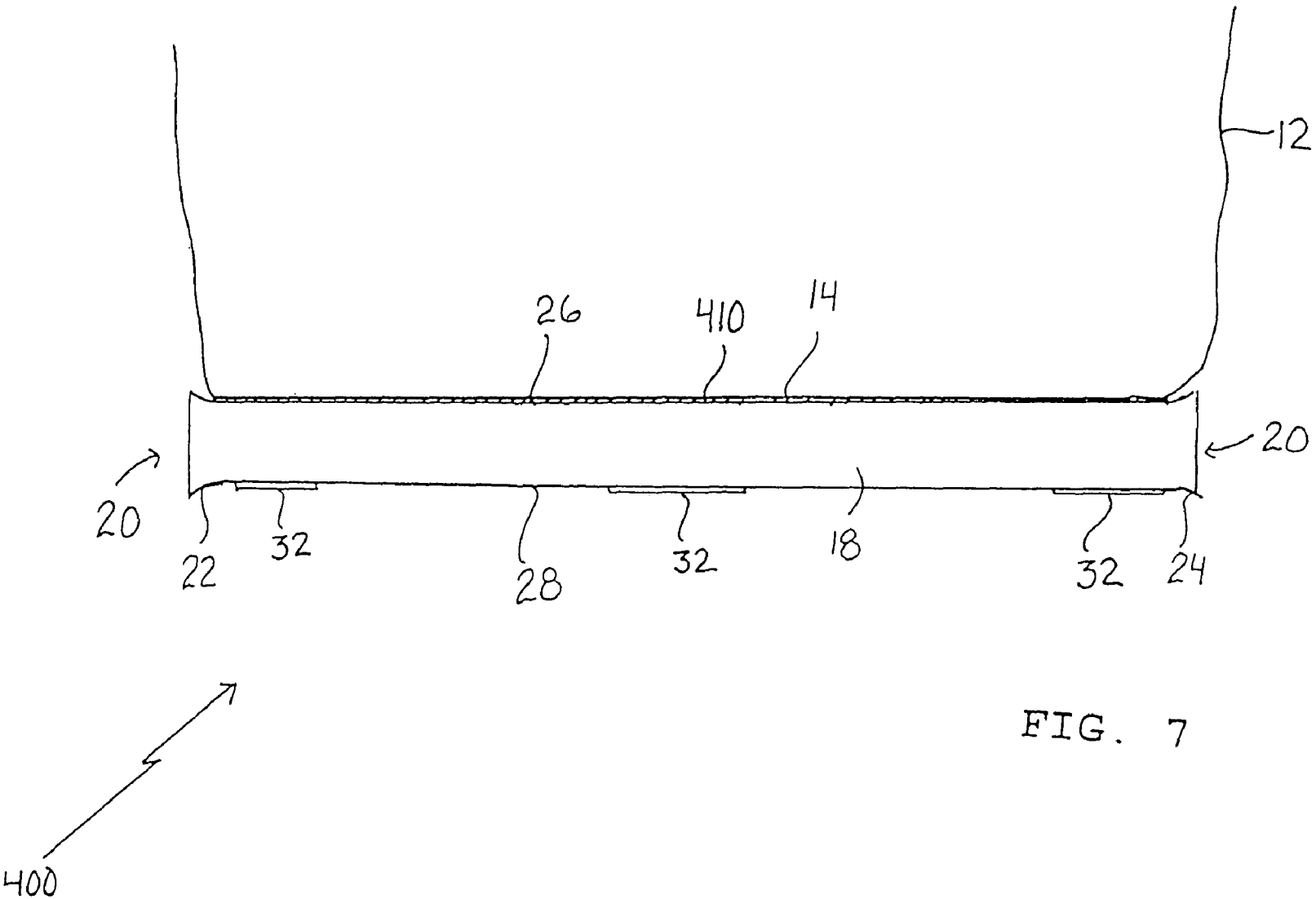
FIG. 7 is side elevation view, in section, of a fifth embodiment of bulk bag.

Referring to FIG. 7, there is illustrated a fifth embodiment of bulk bag, generally referenced by numeral 400. Fifth embodiment of bulk bag 400 has pallet members 18 which are bonded directly to bottom 14 of bag body 12 by powerful adhesive 410, such that no elastic sleeves, lacing or straps are required. The use of adhesives in fabrication is becoming increasingly common and provides an alternative to the use of elastic sleeves, lacing or straps.

Figure 8:
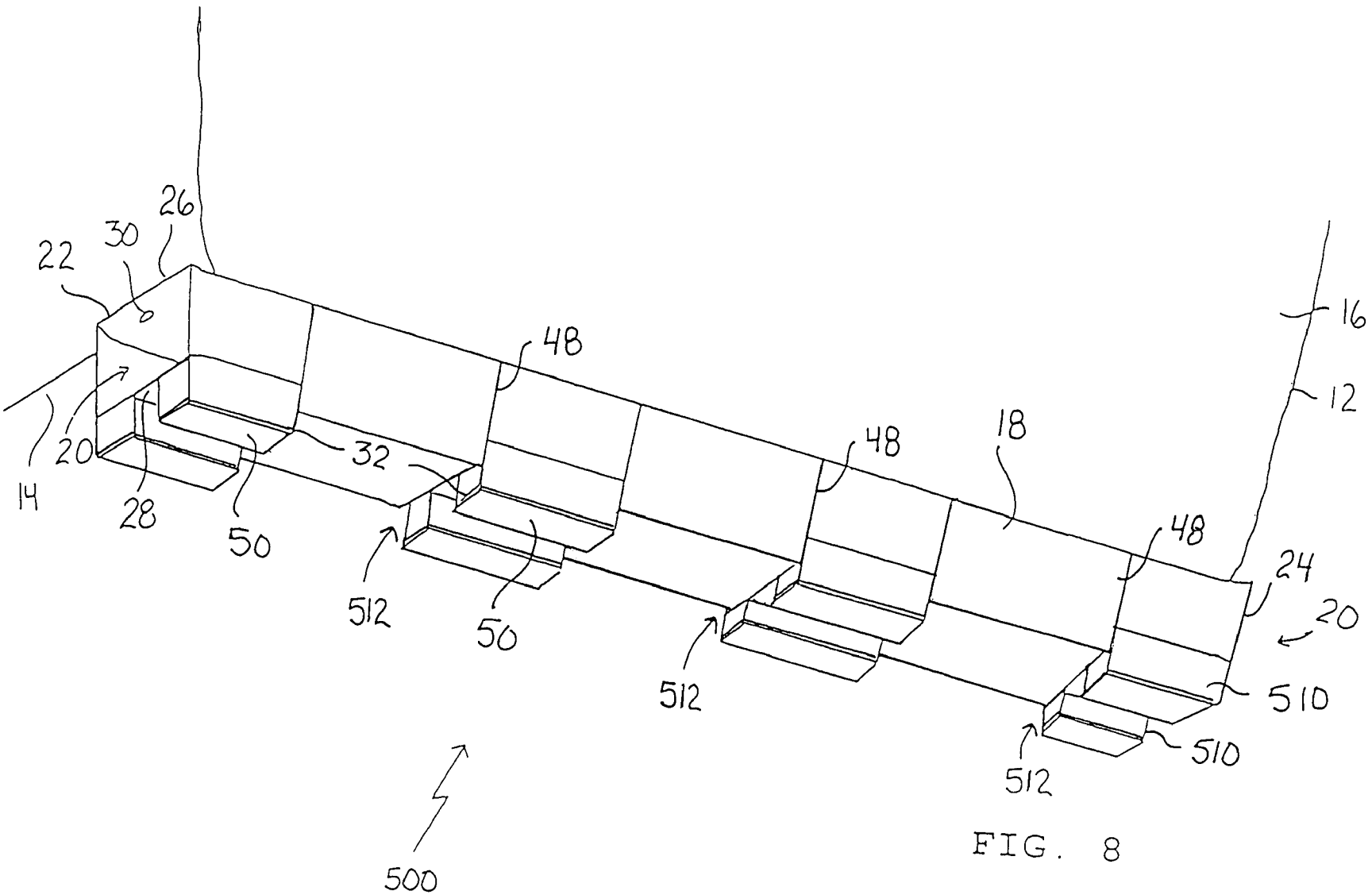
FIG. 8 is a perspective bottom view of a sixth embodiment of bulk bag which has runners.

Referring to FIG. 8, there is illustrated a sixth embodiment of bulk bag generally referenced by numeral 500. Sixth embodiment of bulk bag 500 has runners 510 that extend longitudinally along bottom 28 of each pallet member 18. Runners 510 have indented portions 512 which accommodate elasticized sleeves 48, or other securing means such as laces 114 or straps 112 illustrated in FIG. 4, for the purpose of securing pallet members 18 to bottom 14 of bag body 12. Runners 510 have wear pads 32 which serve as wear surfaces 50 to protect elasticized sleeves 48 from wear.

Figure 9:
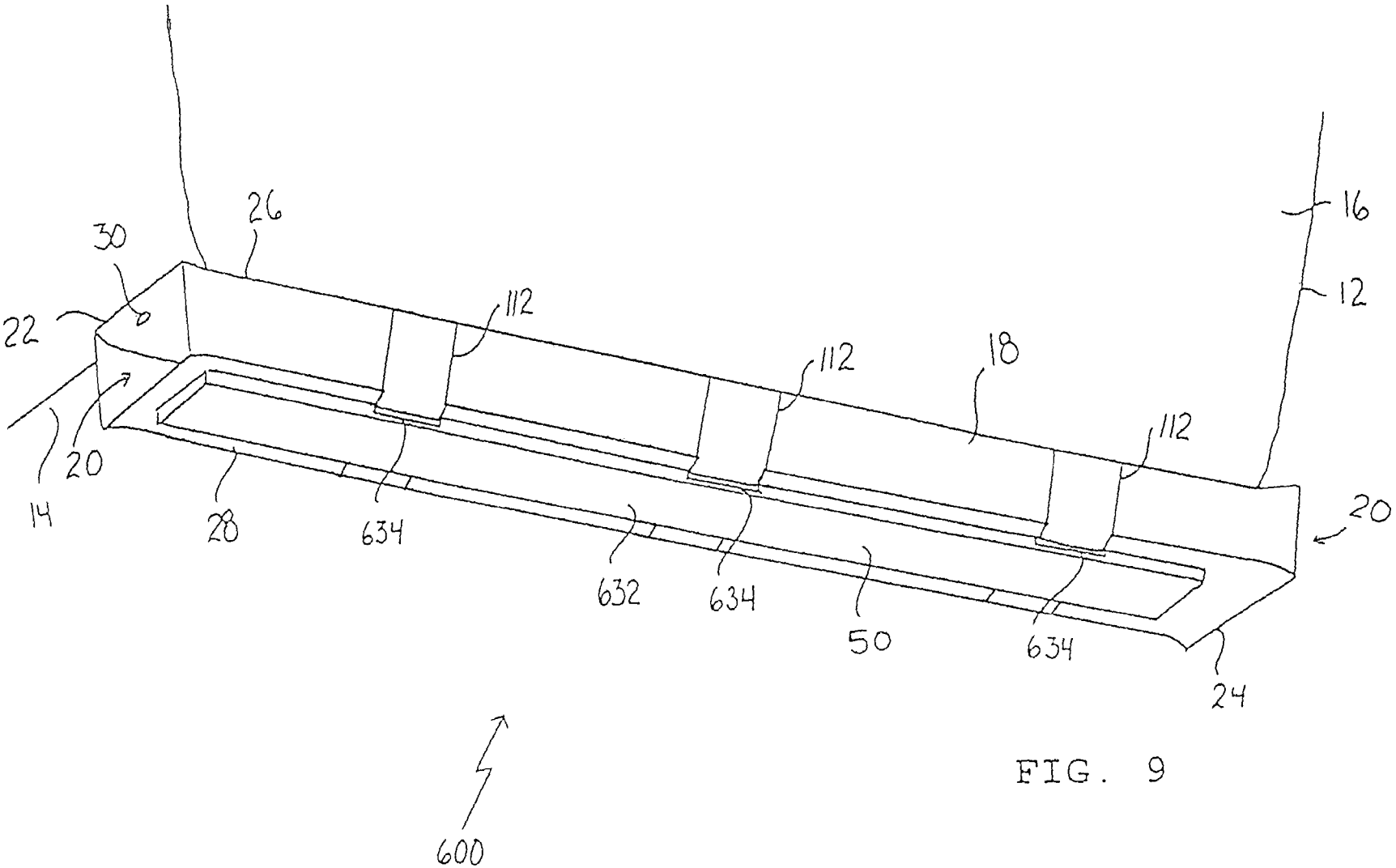
FIG. 9 is a perspective bottom view of a seventh embodiment of bulk bag which has a single wear pad.

Referring to FIG. 9, there is illustrated a seventh embodiment of bulk bag generally referenced by numeral 600 which has a single wear pad 632 on each pallet member 18. Single wear pad 632 extends longitudinally along bottom 28 of each pallet member 18. Single wear pad 632 has several apertures 634 which extend laterally through single wear pad 632 to accommodate straps 112 or other means for securing pallet members 18 to bottom 14 of bag body 12. Single wear pad 632 serves as wear surface 50 to protect straps 112 from wear.

Figure 10:
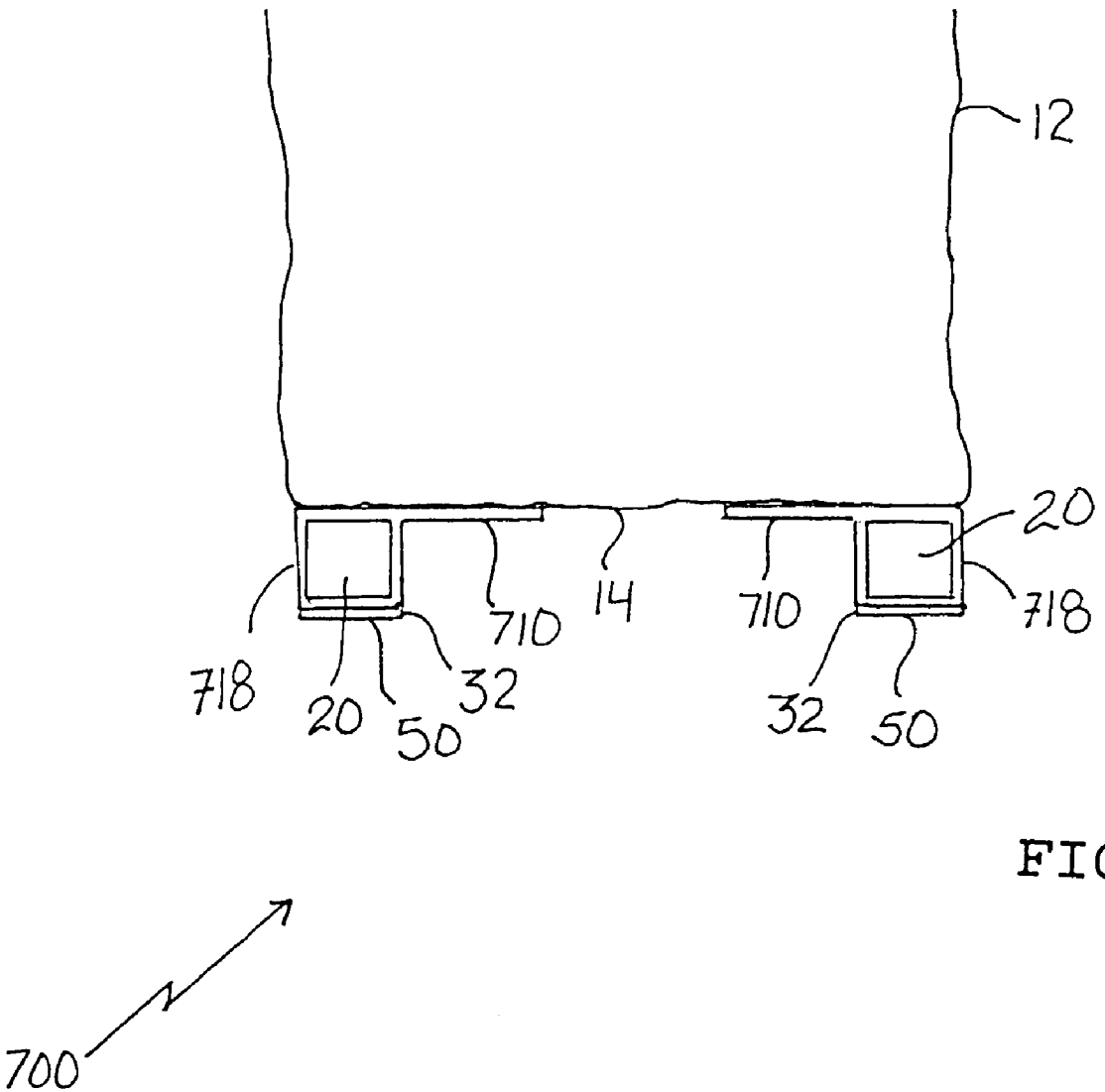
FIG. 10 is a end elevation view of an eighth embodiment of bulk bag where the pallet members has a wing.
Figure 11:
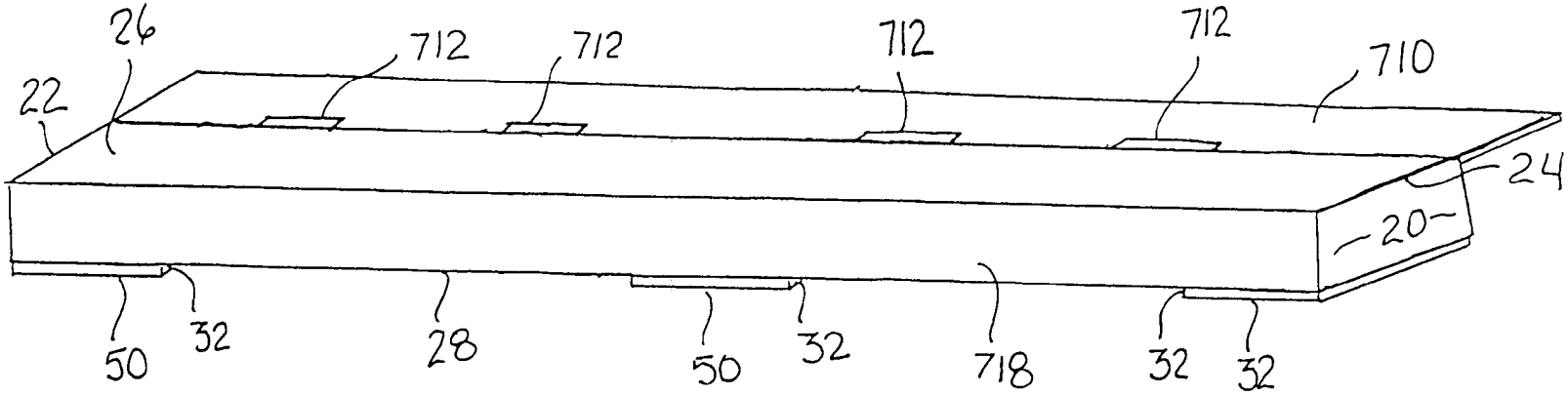
FIG. 11 is a perspective top view of the pallet member illustrated in FIG. 10.
Figure 12:
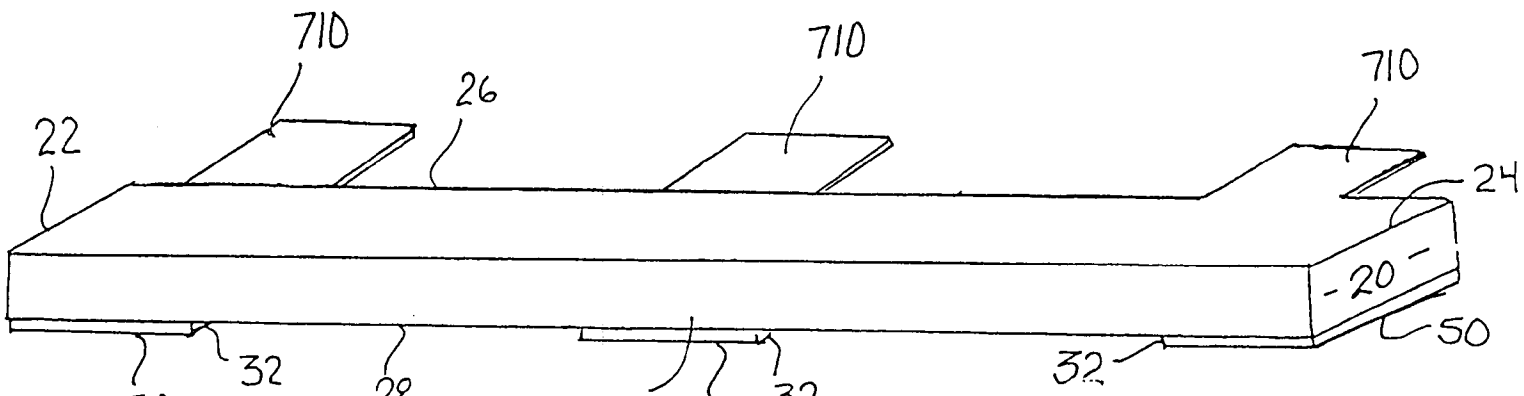
FIG. 12 is a perspective top view of an alternative form of the pallet member illustrated in FIG. 11, with multiple wings.

Referring to FIG. 10, there is illustrated an eighth embodiment of bulk bag generally referenced by numeral 700 which includes pallet members 718 that each have a wing 710. Referring to FIG. 11, wing 710 extends outwardly from and beyond top surface 26 of each pallet member 718 and along the length of each pallet member 718. Apertures 712 are provided along wing 710 to receive straps 112 illustrated in FIG. 4, which are used to secure pallet members 718 to bag body 12. Referring to FIG. 10, when pallet members 718 are secured to bottom 14 of bag body 12, wings 710 on each of pallet members 718 serve to support bottom 14 of bag body 12 to minimize sagging of bag body 12 between pallet members 718 when bulk bag 10 is being moved by a forklift. Referring to FIG. 12, in the alternative, pallet members 710 could have multiple wings 710 which extend beyond top surface 26 of each pallet member 718 and are positioned in spaced relation along the length of each pallet member 718. Straps 112 illustrated in FIG. 4, or elasticized sleeves 40 illustrated in FIG. 1, can be positioned in between each of wings 710 for the purpose of securing pallet members 718 to bottom 14 of bag body 12.

In this patent application reference has been made to a generally tubular structure having "voids". Depending the method used to make the tubular structure, there may be different ways of describing this same structure. For example, a "C" channel structure can be closed in places by attaching wear pads. It will be understood that this and other similar structures to which wear pads have been added end up being generally tubular with voids between the wear pads. The terminology should, therefore, be broadly interpreted to include such structures.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A bulk bag with integral pallets, comprising:

a flexible bag body having a bottom and sidewalls;

at least two elongate tubular pallet members having axially extending openings adapted to receive fork tines from a fork lift, each of the at least two elongate tubular pallet members having at least one underlying wear pad with strap receiving apertures extending transversely through the at least one underlying wear pad; and means for securing each of the at least two elongate pallet members to the bottom of the bag body with the at least one underlying wear pad exposed, in the form of straps extending from the bag body transversely through the strap receiving apertures and underlying the at least two elongate tubular pallet members.

2. The bulk bag with integral pallets as defined in claim 1, wherein each of the at least two elongate pallet members has a first end and a second end, a single underlying wear pad extending between the first end and the second end.

3. The bulk bag with integral pallets as defined in claim 1, wherein the at least one underlying wear pad is removable from each of the at least two elongate pallet members for replacement.

4. The bulk bag with integral pallets as defined in claim 1, wherein each of the at least two elongate pallet members has a textured top gripping surface adapted to frictionally engage the bottom of the bulk bag.

5. The bulk bag with integral pallets as defined in claim 4, wherein the gripping surface is textured by a plurality of ribs.

6. The bulk bag with integral pallets as defined in claim 5, wherein the ribs are generally parallel and extend transversely across each of the elongate pallet members.

7. The bulk bag with integral pallets as defined in claim 1, wherein each of the at least two pallet members are made from polymer plastic.

8. The bulk bag with integral pallets as defined in claim 7, wherein the at least one wear pad is integrally moulded as part of each of the at least two polymer plastic pallet members.

9. The bulk bag with integral pallets as defined in claim 7, wherein each of the at least two polymer plastic pallets members is fabricated in a generally tubular configuration with voids, thereby reducing their weight.

10. The bulk bag with integral pallets as defined in claim 9, wherein the voids include perforations.

11. The bulk bag with integral pallets as defined in claim 9, wherein the voids include cut outs.

12. The bulk bag with integral pallets as defined in claim 1, wherein the axially extending openings are fluted, thereby providing a guide for the entry of fork tines from the fork lift.

13. The bulk bag with integral pallets as defined in claim 1, wherein each of the at least two elongate pallet members has at least one wing extending laterally from one side.

14. The bulk bag with integral pallets as defined in claim 1, wherein at least one of the at least two elongate pallet members has an electronic identification carrier adapted to be identify said elongate pallet member and distinguish it from other pallet members upon electronic interrogation.

15. The bulk bag with integral pallets as defined in claim 14 wherein the electronic identification carrier is a microchip capable of encoding data regarding at least one of the contents, weight, or shipping destination of the bulk bag.

* * * * *